US008218991B2

(12) United States Patent
Nakayama et al.

(10) Patent No.: US 8,218,991 B2
(45) Date of Patent: Jul. 10, 2012

(54) FIXING DEVICE FOR IMAGE FORMING APPARATUS

(75) Inventors: Hiroshi Nakayama, Mishima (JP); Yohei Doi, Mishima (JP); Tetsuo Kitamura, Mishima (JP); Osamu Takagi, Chofu (JP); Satoshi Kinouchi, Shinjuku-ku (JP); Yoshinori Tsueda, Fuji (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 837 days.

(21) Appl. No.: 11/942,085

(22) Filed: Nov. 19, 2007

(65) Prior Publication Data

US 2008/0118266 A1 May 22, 2008

Related U.S. Application Data

(60) Provisional application No. 60/866,674, filed on Nov. 21, 2006.

(30) Foreign Application Priority Data

Nov. 12, 2007 (JP) ..... 2007-293116

(51) Int. Cl.
*G03G 15/20* (2006.01)

(52) U.S. Cl. ..... 399/69; 399/70; 399/333; 219/619; 430/124.3; 430/124.31; 430/124.32

(58) Field of Classification Search ..... 399/70, 399/67, 69, 333; 219/619; 430/124.3, 124.31, 430/124.32
See application file for complete search history.

(56) References Cited

U.S. PATENT DOCUMENTS

| | | | | |
|---|---|---|---|---|
| 6,047,158 | A * | 4/2000 | Morigami et al. | 399/328 |
| 6,094,559 | A * | 7/2000 | Otsuka et al. | 399/327 |
| 6,763,205 | B2 * | 7/2004 | Izawa et al. | 399/69 |
| 6,778,804 | B2 * | 8/2004 | Yoshinaga et al. | 399/325 |
| 7,013,097 | B2 * | 3/2006 | Akizuki et al. | 399/69 |
| 7,139,499 | B2 * | 11/2006 | Sasamoto et al. | 399/69 |
| 7,702,272 | B2 * | 4/2010 | Mitsuoka et al. | 399/328 |
| 7,787,789 | B2 * | 8/2010 | Nakayama et al. | 399/69 |

(Continued)

FOREIGN PATENT DOCUMENTS

JP 2002-295452 10/2002

(Continued)

OTHER PUBLICATIONS

Japanese Office Action for Japanese Application No. 2007-293116 mailed on Jan. 31, 2012.

*Primary Examiner* — David Gray
*Assistant Examiner* — Geoffrey Evans
(74) *Attorney, Agent, or Firm* — Turocy & Watson, LLP

(57) ABSTRACT

A fixing device according to an embodiment of the present invention heats a metal conductive layer of a heat roller using an induction current generating coil. In order to supplement a heat capacity of the heat roller, a press roller having a large heat capacity is heated by a halogen lamp. During a start of activation of an image forming apparatus, when a printer control circuit is started, the supply of electric power to the halogen lamp is started before warming-up is started.

13 Claims, 5 Drawing Sheets

U.S. PATENT DOCUMENTS

| | | | | |
|---|---|---|---|---|
| 8,036,557 | B2 * | 10/2011 | Kinouchi et al. | 399/69 |
| 8,050,612 | B2 * | 11/2011 | Kinouchi et al. | 399/333 |
| 2004/0239749 | A1 * | 12/2004 | Kagawa et al. | 347/156 |
| 2005/0135828 | A1 * | 6/2005 | Joichi et al. | 399/75 |
| 2005/0201783 | A1 * | 9/2005 | Kurotaka et al. | 399/329 |
| 2006/0210293 | A1 * | 9/2006 | Sone et al. | 399/69 |
| 2007/0036571 | A1 * | 2/2007 | Kagawa et al. | 399/69 |
| 2007/0088963 | A1 * | 4/2007 | Nakaya | 713/300 |
| 2007/0108191 | A1 * | 5/2007 | Takagi et al. | 219/619 |
| 2007/0127959 | A1 * | 6/2007 | Tatematsu et al. | 399/329 |
| 2007/0189796 | A1 * | 8/2007 | Chae et al. | 399/69 |
| 2007/0223952 | A1 * | 9/2007 | Ishikawa | 399/69 |
| 2007/0246457 | A1 * | 10/2007 | Tsueda et al. | 219/619 |
| 2011/0287358 | A1 * | 11/2011 | Kinouchi et al. | 430/124.3 |
| 2011/0293309 | A1 * | 12/2011 | Hase | 399/69 |
| 2011/0311255 | A1 * | 12/2011 | Katakura | 399/70 |
| 2011/0311256 | A1 * | 12/2011 | Furuyama | 399/70 |
| 2011/0311257 | A1 * | 12/2011 | Nozawa et al. | 399/70 |

FOREIGN PATENT DOCUMENTS

| | | |
|---|---|---|
| JP | 2005-142023 | 6/2005 |
| JP | 2005-189507 | 7/2005 |

* cited by examiner

FIXING DEVICE FOR IMAGE FORMING APPARATUS

CROSS REFERENCE TO RELATED APPLICATION

This invention is based upon and claims the benefit of priority from prior U.S. Patent Application 60/866,674 filed on Nov. 21, 2006, and Japanese Patent Application 2007-293116 filed on Nov. 12, 2007 the entire contents of which are incorporated herein by reference.

BACKGROUND OF THE INVENTION

1. Field of the Invention

The present invention relates to a fixing device mounted on image forming apparatuses such as a copying machine, a printer, and a facsimile, and, more particularly to a fixing device for an image forming apparatus that performs warming-up at high speed.

2. Description of the Related Art

As a fixing device of an induction heating system used in image forming apparatuses of an electrophotographic system such as a copying machine and a printer, there is a device that quickens a rise in temperature of the fixing device to realize a reduction in a warming-up time. For example, JP-A-2002-295452 discloses a heating device that causes a metal sleeve having a small heat capacity on an outer circumference of a heat roller to generate heat using an induction coil and reduces a warming-up time.

However, if the heat capacity of the heat roller is reduced using the metal sleeve in order to quicken a temperature rise in the heat roller as in the heating device in the past, it is difficult for the heat roller to keep fixing temperature when image formation is continuously performed. When the temperature of the heat roller falls, the heat roller has to be heated to fixable temperature again. Therefore, fixing of images takes time, an increase in speed of image formation is not realized, and it is likely that fixing performance is adversely affected.

Therefore, as the fixing device of the induction heating system, there is a demand for development of a fixing device for an image forming apparatus that can keep fixing temperature even in continuous image formation without damaging a high-speed temperature rise in warming-up and obtain a high-quality fixed image at high speed.

SUMMARY OF THE INVENTION

According to an aspect of the present invention, there is provided a fixing device for an image forming apparatus that realizes prevention of a temperature fall during continuous image formation, does not damage a reduction in a warming-up time, and can obtain a high-quality fixed image at high speed.

According to an embodiment of the present invention, a fixing device for an image forming apparatus includes a fixing member that is used in the image forming apparatus, the overall operation of which is controlled by a first controller, and nips a recording medium between a heat generating member having a metal conductive layer and an opposed member coming into press contact with the heat generating member and carries the recording medium in a predetermined direction, an induction current generating coil arranged near the metal conductive layer, a heater that heats the opposed member, and a second controller that controls, independent from the first controller, electric power supplied to the induction current generating coil and the heater. After a start of activation of the image forming apparatus, when the second controller completes activation, electric power is supplied to the heater.

DETAILED DESCRIPTION OF THE INVENTION

An embodiment of the present invention will be hereinafter explained in detail with reference to the accompanying drawings.

Figure 1:
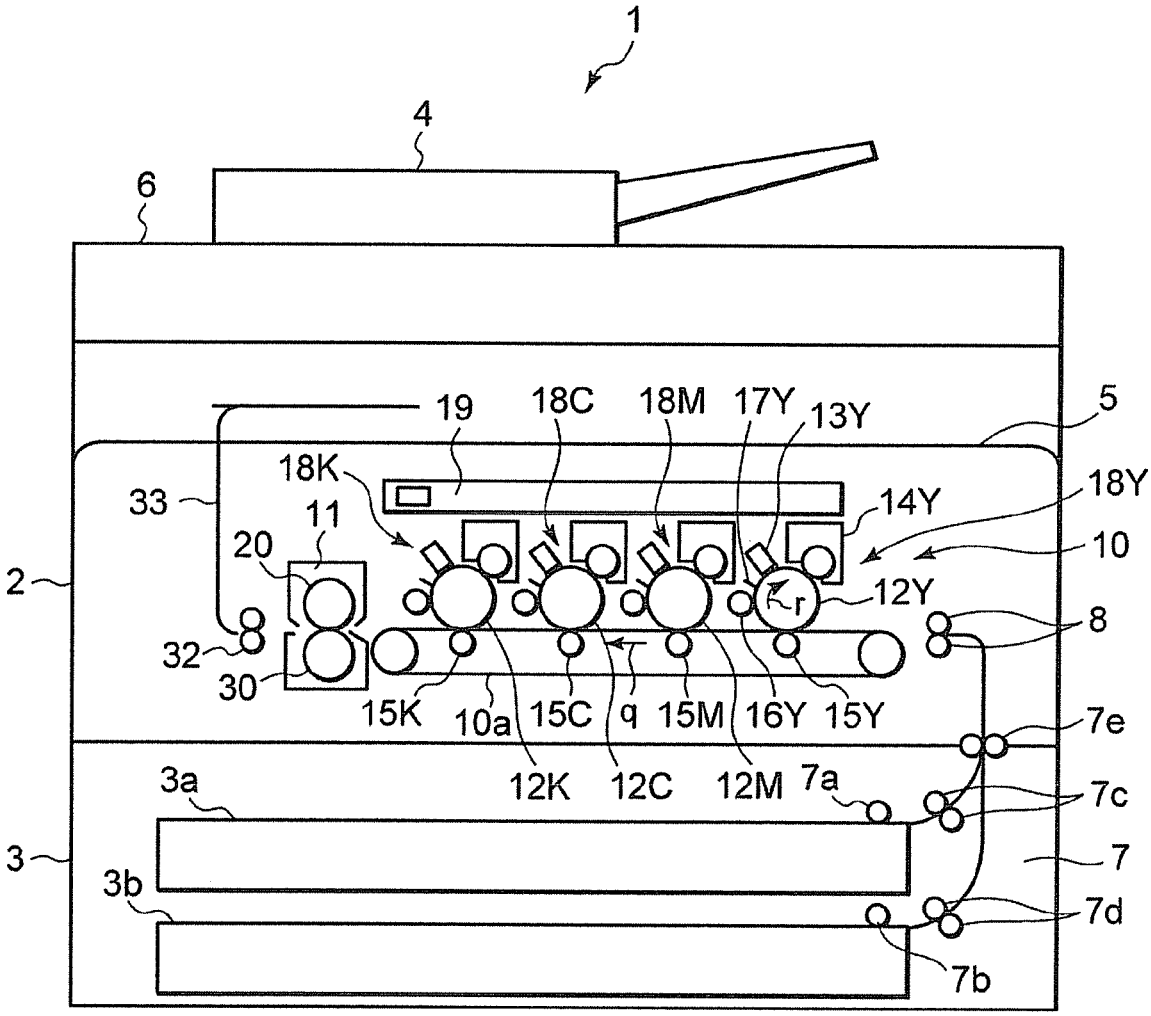
FIG. 1 is a schematic structural view showing an image forming apparatus according to an embodiment of the present invention.

FIG. 1 is a schematic structural view showing an image forming apparatus 1 of an image forming system according to the embodiment. The image forming apparatus 1 includes a scanner unit 6 that scans an original, a printer unit 2 that forms an image, and a paper feeding unit 3 that feeds sheet paper P as a recording medium to the printer unit 2. The scanner unit 6 converts image information scanned from an original supplied by a document feeder 4, which is provided on an upper surface thereof, into an analog signal.

The printer unit 2 includes an image forming unit 10 as an image forming unit in which image forming stations 18Y, 18M, 18C, and 18K for respective colors of yellow (Y) magenta (M), cyan (C), and black (K) are arranged in tandem along a transfer belt 10*a* rotated in an arrow "q" direction. The image forming unit 10 includes a laser exposure device 19 that irradiates laser beams corresponding to image information to photoconductive drums 12Y, 12M, 12C, and 12K of the image forming stations 18Y, 18M, 18C, and 18K for the respective colors. The printer unit 2 further includes a fixing device 11, a paper discharge roller 32, and a paper discharge and conveying path 33 that conveys the sheet paper P after fixing to a paper discharge unit 5.

In the image forming station 18Y for yellow (Y) of the image forming unit 10, a charging device 13Y, a developing device 14Y, a transfer roller 15Y, a cleaner 16Y, and a charge removing device 17Y are arranged around the photoconductive drum 12Y that rotates in an arrow "r" direction. The image forming stations 18M, 18C, and 18K for the respective colors of magenta (M), cyan (C), and black (K) have the structure same as that of the image forming station 18Y for yellow (Y).

The paper feeding unit 3 includes first and second paper feeding cassettes 3*a* and 3*b*. In a conveying path 7 for the sheet paper P extending from the paper feeding cassettes 3*a* and 3*b* to the image forming unit 10, pickup rollers 7*a* and 7*b* that extract the sheet paper P from the sheet feeding cassettes 3*a* and 3*b*, separating and conveying rollers 7*c* and 7*d*, a conveying roller 7*e*, and a registration roller 8 are provided.

When print operation is started, in the image forming station 18Y for yellow (Y) of the printer unit 2, the photoconductive drum 12Y is rotated in the arrow "r" direction and uniformly charged by the charging device 13Y. Exposure light corresponding to yellow image information scanned by the scanner unit 6 is irradiated on the photoconductive drum 12Y by the laser exposure device 19 and an electrostatic latent image is formed thereon. Thereafter, a toner is supplied to the photoconductive drum 12Y by the developing device 14Y and a yellow (Y) toner image is formed thereon. In the position of the transfer roller 15, this yellow (Y) toner image is transferred onto the sheet paper P conveyed in the arrow "q" direction on the transfer belt 10*a*. After the transfer of the toner image is finished, a residual toner is removed from the photoconductive drum 12Y by the cleaner 16Y and electric charge on the surface of the photoconductive drum 12Y is removed by the charge removing device 17. In this way, the photoconductive drum 12Y is prepared for the next printing.

Toner images are formed in the image forming stations 18M, 18C, and 18K for the respective colors of magenta (M), cyan (C), and black (K) in the same manner as the image formation in the image forming station 18Y for yellow (Y). In the positions of the respective transfer rollers 15M, 15C, and 15K, the toner images of the respective colors formed in the image forming stations 18M, 18C, and 18K are sequentially transformed onto the sheet paper P on which the yellow toner image is formed. A color toner image is formed on the sheet paper P in this way. The sheet paper P is heated and pressed to have the color toner image fixed thereon by the fixing device 11 to complete a print image. Then, the sheet paper P is discharged to the paper discharge unit 5.

Figure 2:
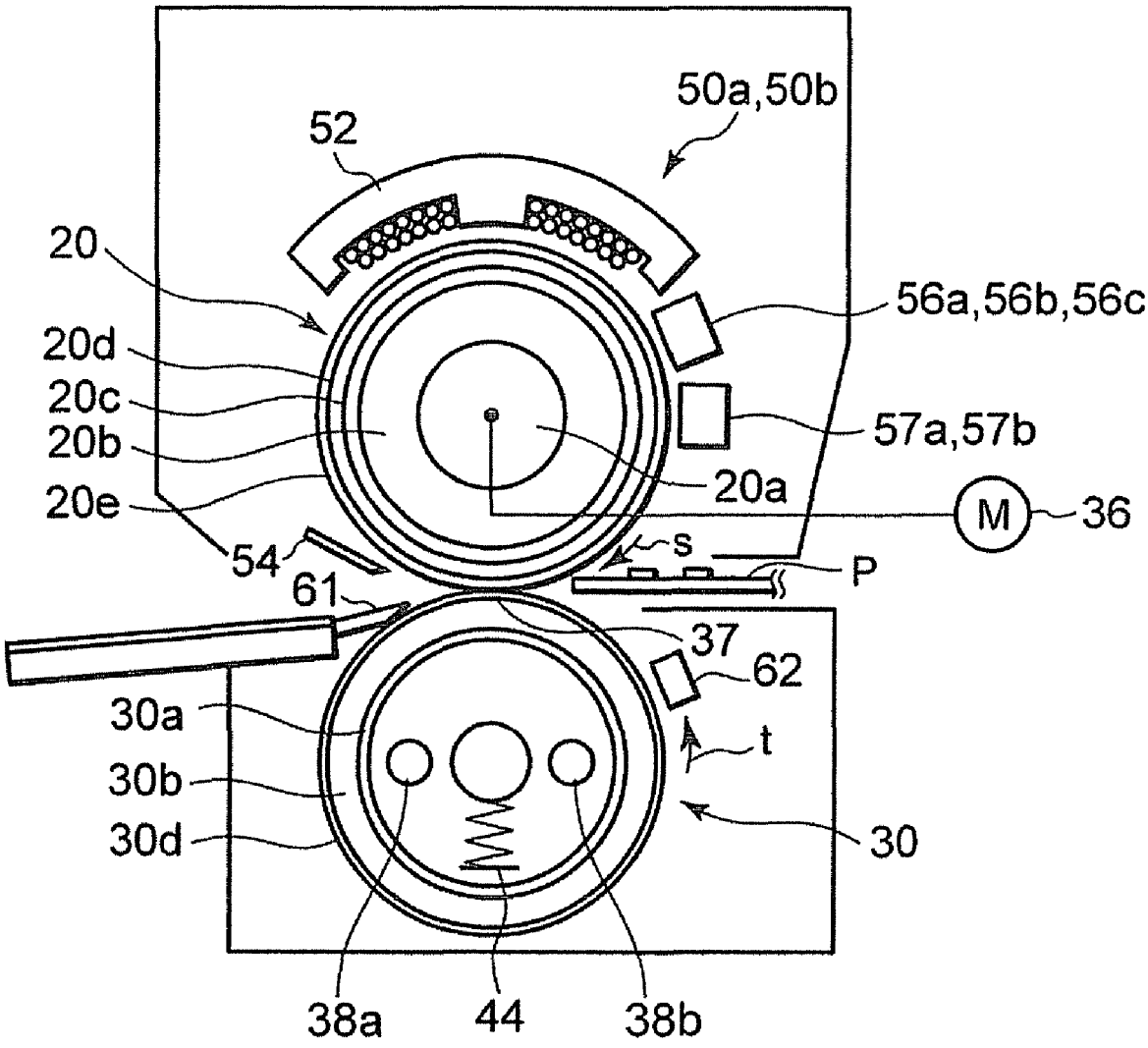
FIG. 2 is a schematic structural view of a fixing device according to the embodiment viewed from an axial direction thereof.

Now, the fixing device 11 is explained. FIG. 2 is a schematic structural view of the fixing device 11 viewed from an axial direction thereof. The fixing device 11 includes a heat roller 20 as a heat generating member and a press roller 30 as an opposed member. Diameters of the heat roller 20 and the press roller 30 are set to 40 mm. The heat roller 20 is driven in an arrow "s" direction by a driving motor 36 as a driving source. The press roller 30 is pressed and brought into contact with the heat roller 20 by a pressing mechanism including a spring 44. Consequently, a nip 37 having a fixed width is formed between the heat roller 20 and the press roller 30. The press roller 30 is rotated in an arrow "t" direction following the heat roller 20. The heat roller 20 and the press roller 30 constitute a fixing member that nips the sheet paper P in the nip 37 and conveys the sheet paper P in the direction of the paper discharge roller 32.

The heat roller 20 includes, around a metal shaft 20*a*, foam rubber (sponge) 20*b* as an elastic body layer having the thickness of 5 mm, a metal layer 20*c* as a metal conductive layer made of nickel (Ni) having the thickness of 40 μm, a solid rubber layer 20*d* having the thickness of 200 μm, and a release layer 20*e* having the thickness of 30 μm. The metal layer 20*c* may be made of stainless steel, aluminum, a composite material of stainless steel and aluminum, or the like instead of nickel. The thicknesses of the respective layers are not limited. The metal layer 20*c*, the solid rubber layer 20*d*, and the release layer 20*e* may be integrated to be slidable with respect to the foam rubber (sponge) 20*b* instead of being bonded to the foam rubber (sponge) 20*b*.

The press roller 30 is constituted by coating, for example, a silicon rubber layer 30*b* and a release layer 30*d* around a hollow metal shaft 30*a*. The layer thickness of the silicon rubber layer 30*b* of the press roller 30 is not limited. However, taking into account thermal conductivity at the time when first and second halogen lamps 38*a* and 38*b* described later are provided in a hollow portion of the metal shaft 30*a*, it is desirable to set the layer thickness as thin as about 0.2 mm to 3 mm to realize a small temperature difference between an inner side and an outer side of the silicon rubber layer 30*b*.

On the outer circumference of the heat roller 20, a peeling pawl 54, first and second induction current generating coils 50*a* and 50*b* as heat generating means, first to third thermistors 56*a*, 56*b*, and 56*c* as temperature sensors, and first and second thermostats 57*a* and 57*b* are provided. The peeling pawl 54 prevents the sheet paper P after fixing from twining around the heat roller 20. The peeling pawl 54 may be a contact type or a non-contact type. The first and second induction current generating coils 50*a* and 50*b* are provided on the outer circumference of the heat roller 20 via a predetermined gap and cause the metal layer 20*c* of the heat roller 20 to generate heat.

The first and third thermistors 56*a* and 56*c* detect the surface temperature on a side of the heat roller 20 in a non-contact manner and convert the surface temperature into a voltage. The second thermistor 56*b* detects the surface temperature substantially in the center of the heat roller 20 in a non-contact manner and converts the surface temperature into a voltage. As the first to third thermistors 56*a*, 56*b*, and 56*c* in non-contact with the heat roller 20, for example, infrared temperature sensors of a thermopile type are used. The first thermostat 57*a* detects trouble in the surface temperature on the side of the heat roller 20. The second thermostat 57*b* detects trouble in the surface temperature in the center of the heat roller 20. When the first or second thermostat 57*a* or 57*b* has detected trouble, the thermostat 57*a* or 57*b* forcibly turns off the supply of electric power to the first and second induction current generating coils 50*a* and 50*b*.

The first induction current generating coil 50*a* causes a center area of the heat roller 20 to generate heat. The second induction current generating coil 50*b* causes areas on both sides of the heat roller 20 to generate heat. The first and second induction current generating coils 50*a* and 50*b* are supplied electric powers alternately. The electric powers are set to be adjustable, for example, between 200 W to 1100 W. The first and second induction current generating coils 50*a* and 50*b* may be capable of simultaneously outputting electric powers. When the first and second induction current generating coils 50*a* and 50*b* simultaneously output electric powers, the electric powers can be changed in the first and second induction current generating coils 50*a* and 50*b*.

The first and second induction current generating coils 50*a* and 50*b* have a shape substantially coaxial with the heat roller 20 and are formed by winding a wire around a magnetic body core 52 for concentrating magnetic fluxes on the heat roller 20. As the wire, for example, a Litz wire formed by binding plural copper wires coated with heat resistant polyamide-imide and insulated from one another is used. By using the Litz wire as the wire, a diameter of the wire can be set smaller than the depth of penetration of a magnetic field. Consequently, it is possible to effectively feed a high-frequency current to the wire. In this embodiment, the Litz wire is formed by binding nineteen copper wires having a diameter of 0.5 mm.

When a predetermined high-frequency current is supplied to such a Litz wire, the first and second induction current generating coils 50*a* and 50*b* generate a magnetic flux. With this magnetic flux, the first and second induction current generating coils 50*a* and 50*b* generate an eddy-current in the metal layer 20*c* to prevent a magnetic field from changing. Joule heat is generated by this eddy-current and a resistance of the metal layer 20*c* and the heat roller 20 is instantaneously heated.

The press roller 30 includes, for example, first and second halogen lamps 38*a* and 38*b* as heaters in the hollow metal shaft. The first halogen lamp 38*a* heats a center area of the press roller 30 and the second halogen lamp 38*b* heats both sides of the press roller 30. Total power consumption of the first and second halogen lamps 38*a* and 38*b* is set to, for example, 800 W. Infrared heaters may be used as the heaters. On the outer circumference of the press roller 30, a peeling pawl 61, a first press roller thermistor 62*a* that detects the surface temperature in the center of the press roller 30, and a second press roller thermistor 62*b* that detects the surface temperature on the side of the press roller 30 are provided along the rotating direction of the press roller 30. As the press roller thermistors 62*a* and 62*b*, for example, infrared temperature sensors of a non-contact thermopile type are used.

Figure 3:
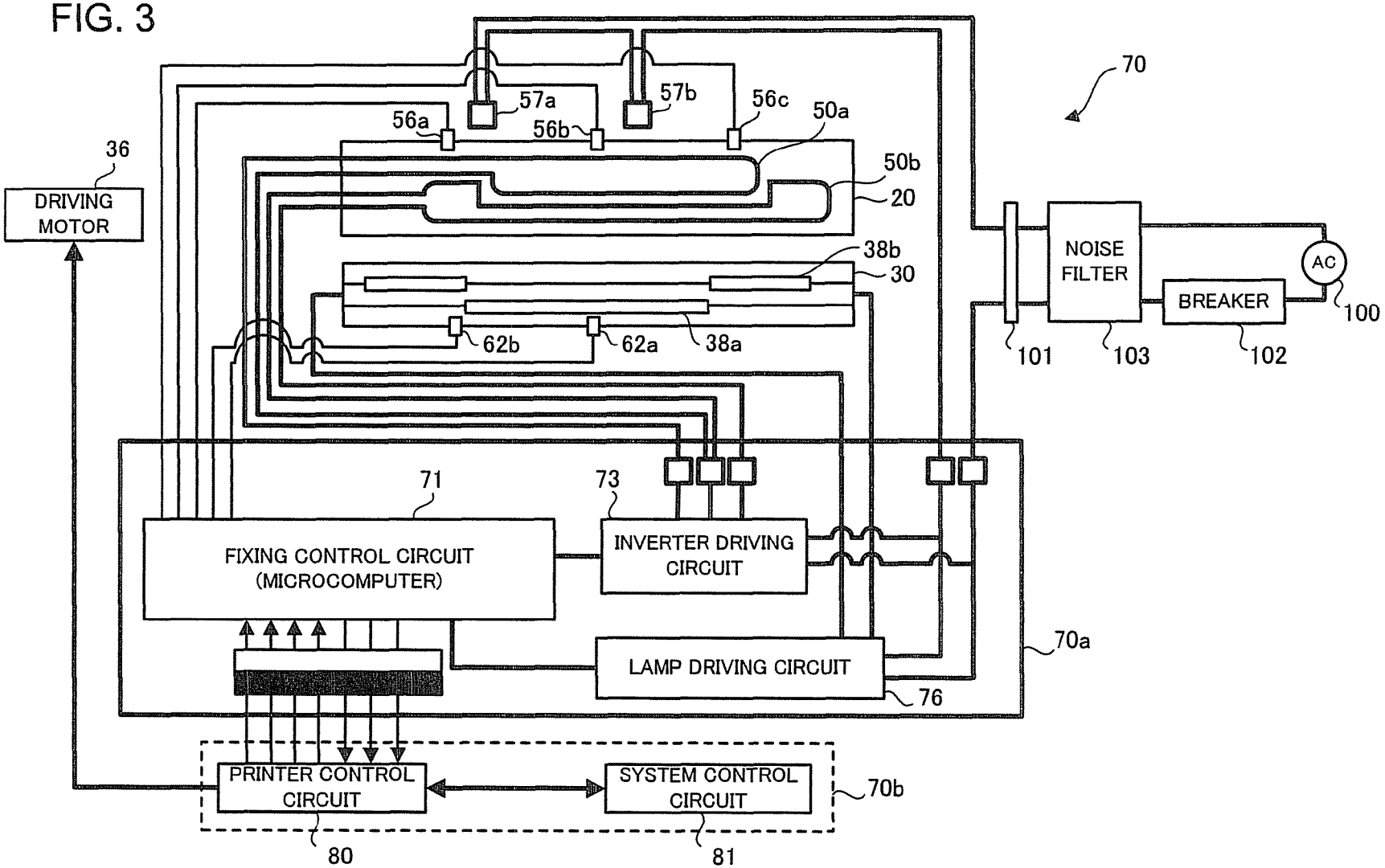
FIG. 3 is a schematic block diagram showing a control system of the fixing device according to the embodiment.

A control system 70 that controls the fixing device 11 is explained with reference to FIG. 3. The control system 70 includes, on a secondary board 70*b*, a printer control circuit 80 as a second controller and a system control circuit 81 as a first controller. The printer control circuit 80 performs operation control for the printer unit 2, the paper feeding unit 3, the driving motor 36, and the like. The system control circuit 81 controls operations of the entire image forming system. The printer control circuit 80 is capable of mutually communicating with the system control circuit 81. In other words, the printer control circuit 80 receives information such as the structure of the entire image forming system and operation modes from the system control circuit 81 and, on the other hand, outputs information on the printer unit 2 and the paper feeding unit 3 to the system control circuit 81. However, the printer control circuit 80 is capable of controlling, independently from the system control circuit 81, electric power supplied to the first and second induction current generating coils 50*a* and 50*b* and the first and second halogen lamps 38*a* and 38*b*. The system control circuit 81 further controls the entire image forming system including optional apparatuses such as a document feeder 4, a finisher, and a facsimile.

On the other hand, the control system 70 includes, on a primary board 70*a*, a fixing control circuit 71 as a microcomputer that performs temperature control for the heat roller 20 and the press roller 30. The fixing control circuit 71 controls an inverter driving circuit 73 that supplies driving power to the first and second induction current generating coils 50*a* and 50*b* and a lamp driving circuit 76 that supplies electric power to the first and second halogen lamps 38*a* and 38*b*. For example, a power of commercial AC power supply 100 is inputted to the inverter driving circuit 73 and the lamp driving circuit 76 via a breaker 102, a noise filter 103, and a main switch 101.

Results of temperature detection by the first to third thermistors 56*a*, 56*b*, and 56*c* and the first and second press roller thermistors 62*a* and 62*b* are inputted to the fixing control circuit 71. The first and second thermostats 57*a* and 57*b* are arranged in a circuit formed by the main switch 101, the inverter driving circuit 73, and the lamp driving circuit 76. The first thermostat 57*a* detects trouble of the surface temperature on the side of the heat roller 20 and forcibly turns off the supply of electric power to the first and second induction current generating coils 50*a* and 50*b* and the first and second halogen lamps 38*a* and 38*b*. The second thermostat 57*b* detects trouble of the surface temperature in the center of the heat roller 20 and forcibly turns off the supply of electric power to the first and second induction current generating coils 50*a* and 50*b* and the first and second halogen lamps 38*a* and 38*b*.

Figure 4:
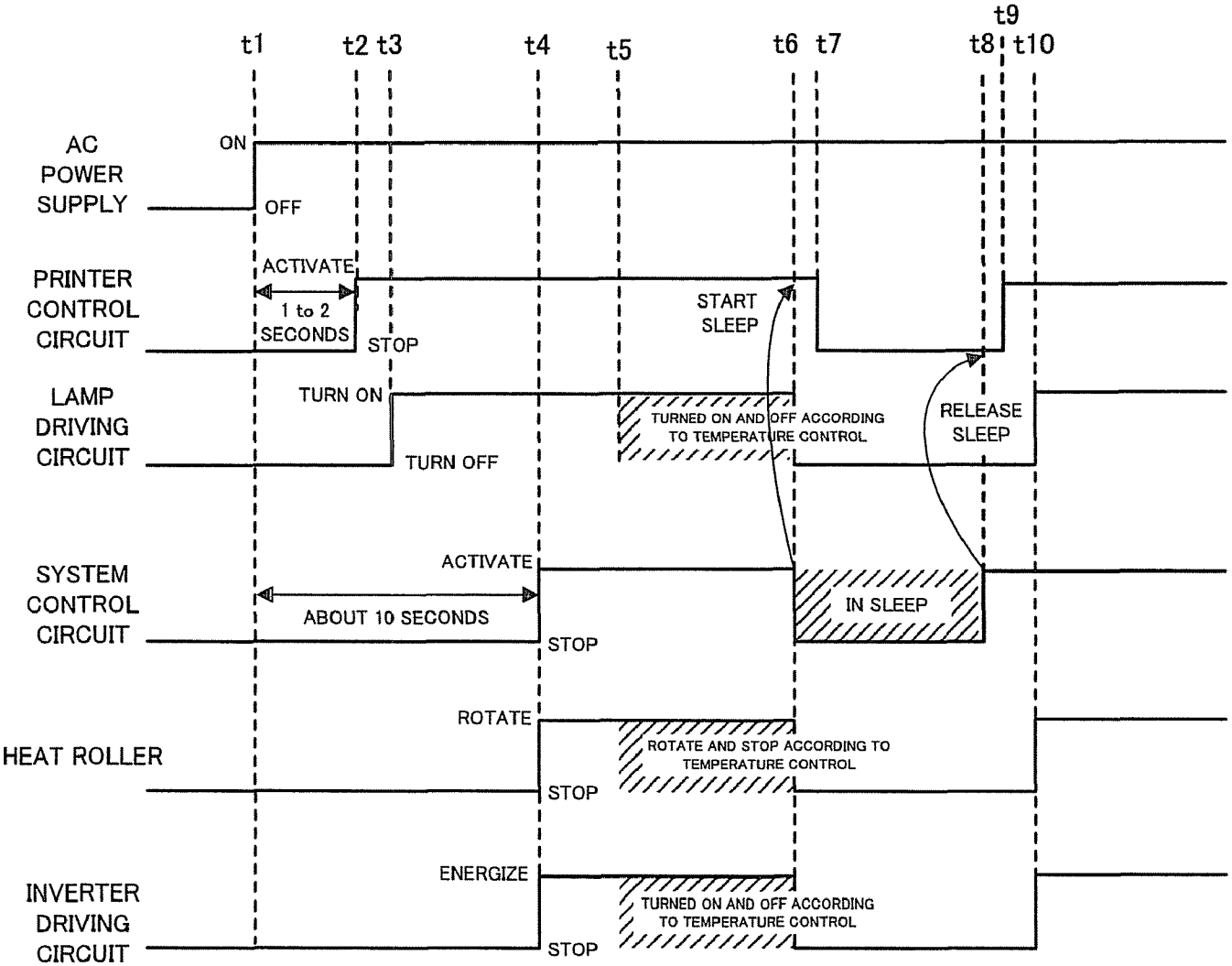
FIG. 4 is a sequence chart showing control of warming-up of the fixing device according to the embodiment.

Control during warming-up of the fixing device 11 by the control system 70 is explained. A sequence chart of control for warming-up of the fixing device 11 carried out by turning on the main switch 101 of the image forming apparatus 1 is shown in FIG. 4. When a user turns on the main switch 101 in order to start activation of the image forming apparatus 1, warming-up of the fixing device 11 is started and the temperatures of the heat roller 20 and the press roller 30 are raised to fixable temperature.

First, the user turns on the main switch 101 at time t1 in order to start activation of the entire image forming system. Consequently, electric power is supplied to the primary board 70*a* and the secondary board 70*b* of the control system 70. The activation of the printer control circuit 80 is completed at time t2, for example, 1 to 2 seconds after the supply of electric power. However, at this time (time t2), the system control circuit 81 is being activated. Since decompression of a program and starting of an OS take time, about 10 seconds is required until the completion of the activation of the system control circuit 81.

Therefore, at a point of time t2 when the printer control circuit 80 completes the activation, the system control circuit 81 has not completed the activation. In other words, since a state of the entire image forming system is unknown, an operation mode of the printer unit 2 is not indicated from the system control circuit 81 to the printer control circuit 80. However, the printer control circuit 80 controls, independently from the system control circuit 81, the circuits on the primary board 70*a* side of the control system 70 of the fixing device 11. In other words, the printer control circuit 80 performs, without being instructed by the system control circuit 81, temperature control or error detection for the heat roller 20 or the press roller 30 using the fixing control circuit 71.

Therefore, the printer control circuit 80 is capable of supplying electric power to the halogen lamps 38*a* and 38*b* and the induction current generating coils 50*a* and 50*b* without waiting for the completion of the activation of the system control circuit 81. However, in the fixing device 11, the press roller 30 requires long time until the press roller 30 reaches the fixable temperature compared with the heat roller 20 having an extremely small heat capacity. Therefore, it is preferable to heat the press roller 30 earlier than the heat roller 20 in order to quicken completion timing of the warming-up of the fixing device 11.

For this purpose, when the printer control circuit 80 completes the activation at time t2, even if the activation of the system control circuit 81 is not completed and an operation mode of the printer unit 2 is not indicated, the printer control circuit 80 controls the lamp driving circuit 76 via the fixing control circuit 71 to supply electric power to the first and second halogen lamps 38*a* and 38*b*. At this point, the fixing device 11 can consume remaining electric power after activation power of the printer control circuit 80 and the system control circuit 81 is subtracted from a total amount of power usable in the entire image forming system. In other words, an amount of power that can be supplied to both the first and second halogen lamps 38*a* and 38*b* is left in the entire image forming system. Therefore, the lamp driving circuit 76 controls both the first and second halogen lamps 38*a* and 38*b* to be turned on. Consequently, at time t3, the first and second halogen lamps 38*a* and 38*b* are turned on and the press roller 30 is started to be heated before the system control circuit 81 indicates a warming-up mode.

While the press roller 30 is heated by the first and second halogen lamps 38*a* and 38*b* in this way, at time t4 when, for example, about 10 seconds elapses after the main switch 101 is turned on, the activation of the system control circuit 81 is completed. Therefore, the system control circuit 81 checks the structure of the entire image forming system or checks a state of the entire image forming system such as a breakdown of an option. If the structure or the state is normal, the system control circuit 81 indicates the warming-up mode to the printer control circuit 80.

When the warming-up mode is indicated by the system control circuit 81, the printer control circuit 80 instructs the driving motor 36 to rotate the heat roller 20. At the same time, the printer control circuit 80 energizes, via the fixing control circuit 71, the inverter driving circuit 73 and controls the inverter driving circuit 73 to supply electric power to the first and second induction current generating coils 50*a* and 50*b*. Consequently, heat generation of the heat roller 20 is started.

However, the total amount of power that can be supplied from the commercial AC power supply 100 to the entire image forming system is fixed. Thus, electric power that can be supplied to the first and second halogen lamps 38*a* and 38*b* and the first and second induction current generating coils 50*a* and 50*b* for the warming-up mode is limited. Therefore, to realize warming-up at high speed, the fixing control circuit 71 optimally distributes an amount of power to the first and second halogen lamps 38*a* and 38*b* and the first and second induction current generating coils 50*a* and 50*b* in a range of electric power usable for the temperature control of the fixing device 11 and feedback-controls the amount of power.

When the activation of the system control circuit 81 is completed (t4), if an error or the like occurs in the image forming system, the system control circuit 81 instructs the printer control circuit 80 to immediately interrupt the supply of electric power to the fixing device 11.

On the other hand, according to the indication of the warming-up mode, results of temperature detection of the first to third thermistors 56*a*, 56*b*, and 56*c* and the first and second press roller thermistors 62*a* and 62*b* are inputted to the fixing control circuit 71. The inverter driving circuit 73 and the lamp driving circuit 76 feedback-control, on the basis of the results of temperature detection, the amount of power supplied to the first and second halogen lamps 38*a* and 38*b* and the first and second induction current generating coils 50*a* and 50*b* such that the heat roller 20 and the press roller 30 reach predetermined fixable temperature.

At the point of time t4 when the activation of the system control circuit 81 is completed, the press roller 30 is already heated by the first and second halogen lamps 38*a* and 38*b* between time t3 and time t4. Therefore, thereafter, according to the feedback control of the amount of power supplied to the first and second halogen lamps 38*a* and 38*b* and the first and second induction current generating coils 50*a* and 50*b*, the heat roller 20 and the press roller 30 reach the predetermined fixable temperature at high speed and becomes in a standby mode (a state in which the heat roller 20 and the press roller 30 immediately become printable when a print instruction is received). After the heat roller 20 and the press roller 30 becomes in the standby mode at time t5, for example, the inverter driving circuit 73 and the lamp driving circuit 76 supply low electric power to the first and second induction current generating coils 50*a* and 50*b* alternately and control to turn on and off the first and second halogen lamps 38*a* and 38*b* such that the heat roller 20 and the press roller 30 keep the fixable temperature.

When a print mode is indicated by the system control circuit 81 during the standby mode, the printer control circuit 80 performs print control. Consequently, the fixing control circuit 71 feedback-controls the heat roller 20 and the press roller 30 in the print mode. For example, when a size of sheet paper P is the JIS standard A4 size, the fixing control circuit 71 supplies electric power to the first induction current generating coil 50*a* and controls to turn on and off the first halogen lamp 38*a*.

When a predetermined time elapses in a state of the standby mode after the end of the print mode, for saving of power consumption, the system control circuit 81 indicates, for example, a sleep mode (a state in which the supply of electric power to the first and second induction current generating coils 50*a* and 50*b* and the first and second halogen lamps 38*a* and 38*b* is interrupted and, when a print instruction is received, the temperatures of the heat roller 20 and the press roller 30 are immediately raised to the fixable temperature). At time t6, when the sleep mode is indicated, the inverter driving circuit 73, the lamp driving circuit 76, the first and second induction current generating coils 50*a* and 50*b*, and the first and second halogen lamps 38*a* and 38*b* are turned off. Thereafter, at time t7, the printer control circuit 80 is also turned off. However, the system control circuit 81 is activated in a state in which the entire image forming system is set in the sleep mode.

Therefore, when a print instruction is received during this period, for example, at time t8, the system control circuit 81 instructs the entire image forming system to release sleep. Consequently, the printer control circuit 80 immediately completes activation from an off state (t9) and, simultaneously with the rotation of the driving motor 36 (t10), energizes the inverter driving circuit 73 and the lamp driving circuit 76. Consequently, the heat roller 20 and the press roller 30 are subjected to temperature control to immediately reach the fixable temperature.

In the fixing device 11 according to this embodiment, the thickness of the metal conductive layer 20*c* is set thin in the heat roller 20 and a heat capacity of the heat roller 20 is set extremely small. Consequently, the heat roller 20 can reach desired temperature in a short time and an increase in speed of warming-up and fixing is realized. The press roller 30 having a large heat capacity is heated by the first and second halogen lamps 38*a* and 38*b*. Consequently, the press roller 30 can compensate for insufficiency of a heat capacity on the heat roller 20 side during continuous fixing and prevent fixing speed is decreasing during the continuous fixing. Moreover, during warming-up after a start of activation of the image forming apparatus, even if activation of the system control circuit 81 is not completed, when the printer control circuit 80 is started, electric power is supplied to the first and second halogen lamps 38*a* and 38*b* before warming-up is instructed by the system control circuit 81. Consequently, the heating of the press roller 30 having a large heat capacity is started before the instruction of warming-up by the system control circuit 81. In other words, the press roller 30 is already heated at time t4 when warming-up is instructed by the system control circuit 81. As a result, regardless of the large heat capacity, a delay in a start of the press roller 30 after the instruction of warming-up can be controlled and a reduction in a warming-up time of the fixing device 11 is realized.

The present invention is not limited to the embodiment and various modifications of the embodiment are possible without departing from the spirit of the present invention. For example, the structure of the fixing device is not limited. For example, the heating member or the opposed member may be formed in a belt shape. Time from the start of activation until the completion of activation of the first controller or the second controller is arbitrary. A range of an amount of power of the heater or an amount of power that can be supplied to the induction current generating coils is also arbitrary as required. Control of operations by the first controller is not limited. For example, in the sequence shown in FIG. 3 in the embodiment, the system control circuit 81 indicates the sleep mode at time t6. However, time of indication of the sleep mode is not limited to this. For example, when a predetermined time elapses in a state of the standby mode after the end of the print mode, at time t6, first, the system control circuit 81 may indicate a pre-heating mode (the fixing member is maintained at predetermined pre-heating temperature lower than the fixable temperature and, when a print instruction is received, the temperature of the fixing member is immediately raised to the fixable temperature) and, then, indicate the sleep mode.

Figure 5:
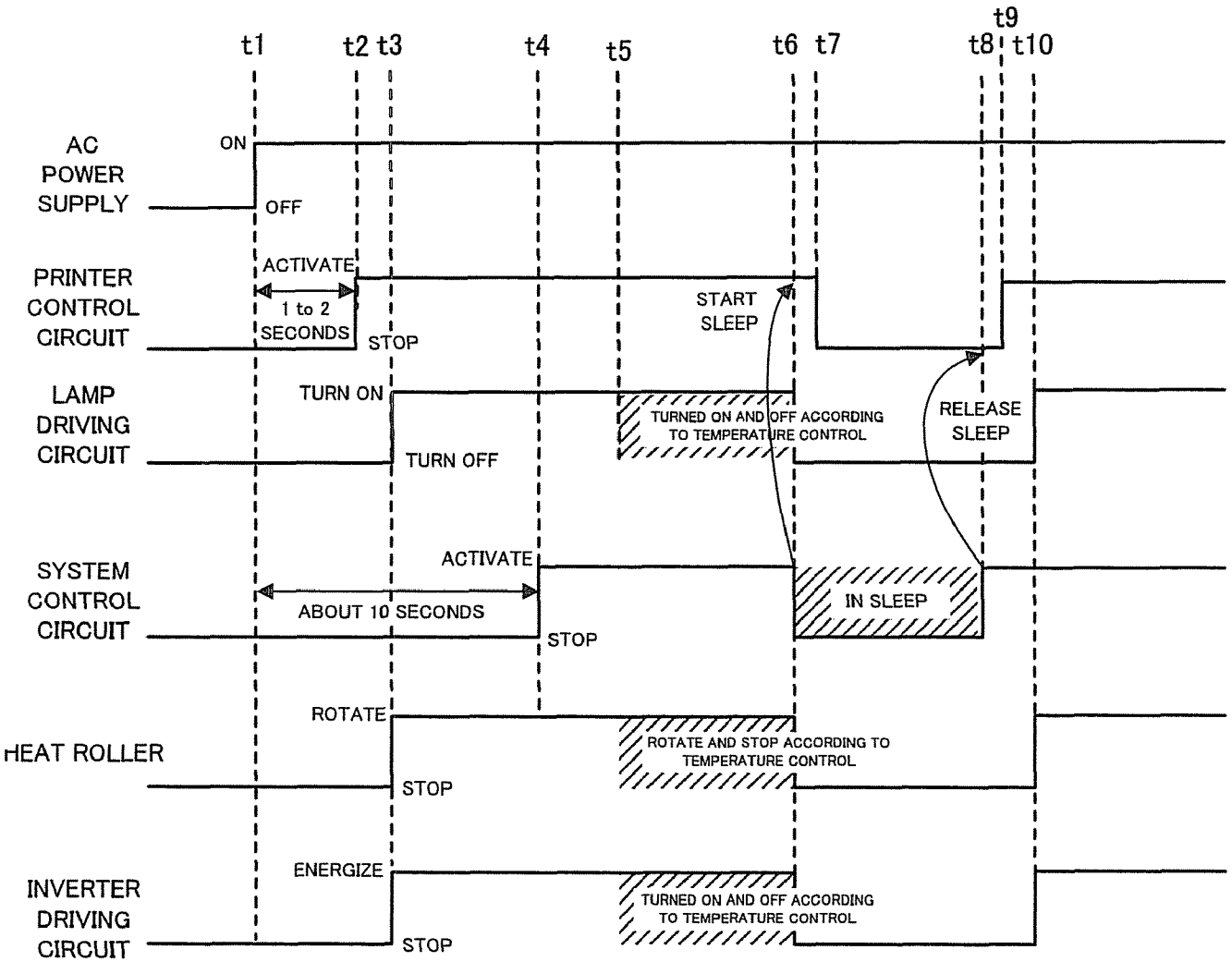
FIG. 5 is a sequence chart showing control of warming-up of a fixing device according to a modification of the embodiment.

Moreover, the sequence for warming up the fixing member to the fixable temperature can also be changed. For example, as in a modification shown in FIG. 5, at time t3 after the activation of the printer control circuit 80 is completed at time t2, the printer control circuit 80 may perform control to turn on the first and second halogen lamps 38*a* and 38*b* and, at the same time, rotate the driving motor 36 and supply electric power to the first and second induction current generating coils 50*a* and 50*b*. Consequently, before the system control circuit 81 indicates the warming-up mode, both the heat roller 20 and the press roller 30 are heated. However, since total electric power that can be supplied from the commercial AC power supply 100 to the entire image forming system is fixed, electric power that can be supplied to the first and second halogen lamps 38*a* and 38*b* and the first and second induction current generating coils 50*a* and 50*b* at time t3 is limited.

Electric power usable for temperature control for the fixing device 11 at time t3 in this modification is electric power left after activation power of the printer control circuit 80 and the system control circuit 81 is subtracted and electric power supplied to at least the driving motor 36 is further subtracted from a total amount of power usable in the entire image forming system. This remaining electric power is allocated to the first and second halogen lamps 38*a* and 38*b* and the first and second induction current generating coils 50*a* and 50*b*. Therefore, at time t3, an amount of power that can be supplied to the first and second halogen lamps 38*a* and 38*b* is limited. More effective heating of the press roller 30 having a large heat capacity is reduced a little before warming-up.

What is claimed is:

1. An image forming apparatus comprising:

an image forming unit;

a fixing member that nips a recording medium having a toner image formed by the image forming unit between a heating member that contacts with the toner image on the recording medium and has a metal conductive layer and a pressing member coming into press contact with the heating member and carries the recording medium in a predetermined direction;

an induction current generating coil arranged near the heating member;

a heater that heats the pressing member;

a driving source for rotating the heating member;

a first controller that controls an operation of the entire image forming apparatus; and a second controller that controls, electric power supplied to the induction current generating coil and the heater, supplies electric power to the heater if after a start of an activation of the image forming apparatus and before a completion of the activation of the first controller and supplies electric power to the induction current generating coil if after a start of the activation of the image forming apparatus and simultaneously with a completion of the activation of the first controller.

2. An image forming apparatus according to claim 1, wherein the second controller also performs print control.

3. An image forming apparatus according to claim 2, further comprising a driving source for rotating at least the heating member, wherein the second controller controls an operation of the driving source.

4. An image forming apparatus according to claim 1, further comprising a microcomputer exclusive for temperature control that controls electric power supplied to the induction current generating coil and the heater, wherein the second controller controls the electric power supplied to the induction current generating coil and the heater via the microcomputer exclusive for temperature control.

5. An image forming apparatus according to claim 1, further comprising:

a temperature sensor that detects temperature of the fixing member; and a microcomputer exclusive for temperature control that controls electric power supplied to the induction current generating coil and the heater, wherein the second controller acquires detection information of the temperature sensor via the microcomputer exclusively for temperature control.

6. An image forming apparatus according to claim 1, wherein the heating member includes a rotating body formed by covering a surface of an elastic body layer with the metal conductive layer, and the induction current generating coil is arranged around the rotating body.

7. An image forming apparatus according to claim 1, wherein, when the image forming apparatus is reset from a sleep mode, supply of electric power to the heater, a start of driving of the driving source, and supply of electric power to the induction current generating coil are simultaneously performed.

8. A fixing control method for an image forming apparatus comprising:

starting activation of the image forming apparatus;

supplying electric power to a heater that heats a pressing member coming into press contact with a heating member that contacts with a toner image on a recording medium and has a metal conductive layer before a completion of activation of the entire image forming apparatus; and supplying electric power to an induction current generating coil which is near the pressing member if simultaneously with a completion of activation of the entire image forming apparatus.

9. A fixing control method for an image forming apparatus according to claim 8, wherein the supply of electric power to the heater is performed via a microcomputer exclusive for temperature control.

10. A fixing method for an image forming apparatus according to claim 8, wherein the supply of electric power to the heater and the supply of electric power to the induction current generating coil are performed via a microcomputer exclusive for temperature control.

11. A fixing method for an image forming apparatus according to claim 8, further comprising, after completion of activation of the image forming apparatus, when the image forming apparatus is reset from a sleep mode, performing rotation of the heating member and supply of electric power to an induction current generating coil, which causes a metal conductive layer of the heating member to generate heat, simultaneously with supplying electric power to the heater.

12. An image forming apparatus, comprising:

a first controller that controls an overall operation to form an image;

a heat roller which is controlled by the first controller, contacts with the toner image on the recording and has a metal conductive layer;

a press roller which is opposed to the heat roller;

an induction current generating coil arranged near the heat roller;

a heater arranged in the press roller and heats the press roller;

a driving source for rotating the heat roller; and a second controller that controls electric power supplied to the induction current generating coil and a heater, supplies electric power to the heater if after a start of an activation of the overall operation and before a completion of the activation of the first controller, and supplies electric power to the induction current generating coil if after a start of the activation of the overall operation and simultaneously with a completion of the activation of the first controller.

13. An apparatus according to claim 12, wherein a heat capacity of the heat roller is smaller than a heat capacity of the press roller.

* * * * *